US005346168A

United States Patent [19]

Astrella

[11] Patent Number: 5,346,168

[45] Date of Patent: Sep. 13, 1994

[54] GUITAR HANGING FIXTURE

[76] Inventor: Joseph G. Astrella, 40 Kenberma Rd., Worcester, Mass. 01604

[21] Appl. No.: 85,929

[22] Filed: Jul. 6, 1993

[51] Int. Cl.[5] ..... E04G 3/00

[52] U.S. Cl. ..... 248/278; 84/327; 248/113

[58] Field of Search ..... 248/276, 278, 279, 281.1, 248/288.5, 316.1, 113, 112, 110, 111, 443; 211/66; 84/327

[56] References Cited

U.S. PATENT DOCUMENTS

| | | | |
|---|---|---|---|
| 2,911,172 | 11/1959 | Clayton et al. | 248/113 |
| 4,084,778 | 4/1978 | Dominguez | 248/443 X |
| 4,470,106 | 9/1984 | Norton | 248/281.1 X |
| 4,880,192 | 11/1989 | Vom Braucke et al. | 211/66 X |
| 4,909,467 | 3/1990 | Shan-Pao | 248/113 X |

*Primary Examiner*—Ramon O. Ramirez

*Attorney, Agent, or Firm*—Roger A. Marrs

[57] ABSTRACT

A hanger fixture is disclosed herein mountable on the side of a road case or trunk for supporting a musical instrument. The hanger fixture includes a mounting plate having a peripheral edge arranged about a recessed support by side members. A hanger is carried on a rotatable shaft within the recess having an operable position cantilevered outwardly from the plate and a storage position within the recess. Also, included is a support bar pivotally mounted on the shaft and having a pair of hanger elements fixed to opposite ends of the shaft separated by the pivot and in fixed parallel relationship. Tension mechanism disposed on the shaft maintains the hanger elements in a desired location and a limit stop cooperatively related between the shaft and the recessed support of the plate maintains the hanger elements in its operative position.

6 Claims, 1 Drawing Sheet

GUITAR HANGING FIXTURE

BACKGROUND OF THE INVENTION

1. Field of the Invention

The present invention relates to the field of musical instrument storage devices, and more particularly, to a novel hanging fixture adapted to be carried on a road case for temporarily storing or holding a musical instrument at the convenience of the musician.

2. Brief Description of the Prior Art

In the past, it has been the conventional practice for a musician, particularly a guitarist, to utilize several guitars or musical instruments during the course of a stage performance. In this connection, the musician must continuously alternate between several guitars of the multiplicity in order to obtain the desired musical effect during the performance. It has been the usual practice to lean instruments, such as guitars, against surrounding road cases, trunks, music stands or the like within reach of the musician. Obviously, this has raised difficulties and problems which stem largely from the fact that the instruments are not well supported in their temporary storage position and in many instances, the instrument will fall to the floor which will damage or untune the instrument making it ineffective for play. Also, no means are available for organizing the instruments so that selected ones are readily visible and reachable by the musician during the performance.

Therefore, a long-standing need has existed for providing a novel means for supporting one or more musical instruments, such as guitars, from a supporting structure, such as a road case, adjacent to the musician so that he may alternately play one of several instruments during the performance and at his selection. Such a support means should include an operable position and a storage position so that it will not interfere with transportation or movement of the road case and yet have an operable position outwardly cantilevered from the road case so that it will adequately and properly support a musical instrument.

SUMMARY OF THE INVENTION

Accordingly, the above problems and difficulties are avoided by the present invention which provides a plate adapted to be mounted on the side of a road case or other support and wherein the plate includes an edge marginal region for holding a fastening means adapted to secure the plate to the road case or other support. The edge marginal region of the plate further includes a recessed central portion which is defined by a continuous sidewall and a support member which mounts a rotatable hanger element or yoke. The hanger element or yoke is pivotally carried on a rotatable shaft or rod extending transversely across the central recess by having its opposite ends rotatably carried on opposing sidewalls of the continuous sidewall. Means are provided for tensioning or biasing the hanger fixture or yoke in a folded position for storage and transport within the central recess and other means are provided for maintaining or retaining the hanger fixture or yoke in an outwardly cantilevered position and at a slight angle with respect to a horizontal plane.

Therefore, it is among the primary objects of the present invention to provide a novel hanger means for releasably supporting a musical instrument from the side of a road case or the like and which includes means for extending a hanger element into an outwardly projecting operative position and for holding the hanger element in a recessed storage position when not in use.

Another object of the present invention is to provide a novel hanger means for supporting a musical instrument, having means for tensioning or biasing the hanger in its folded condition as well as during its travel from a folded position to an operative position, and further including means for retaining the hanger in its operative position.

Another object of the present invention is to provide a novel hanger means for conveniently storing a musical instrument in close proximity to the musician so that musical instruments can be alternately selected and played by the musician.

Yet another object of the present invention is to provide a novel hanger means which, when in its operative position, is slightly angled or slanted away from a horizontal plane serving as a keeper for retaining the instrument on the hanger when the instrument is being supported therefrom.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

DESCRIPTION OF THE PREFERRED EMBODIMENT

Figure 1:
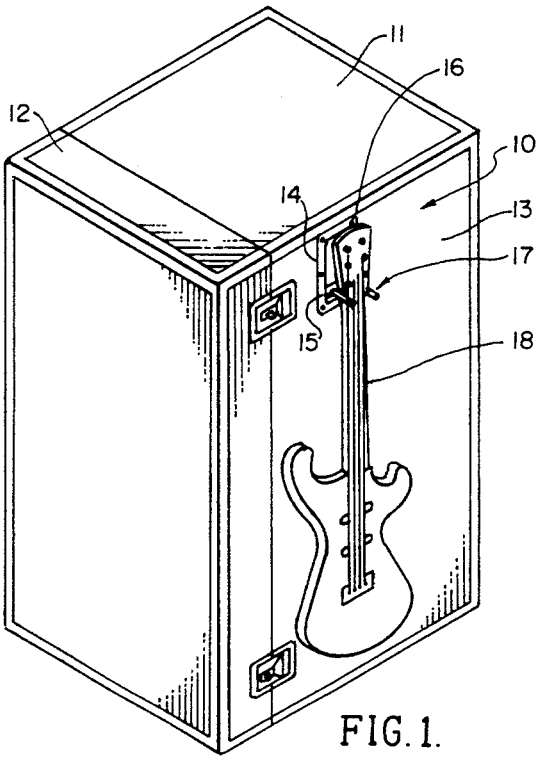
FIG. 1 is a front perspective view showing a road case having the hanger apparatus of the present invention disposed on one side thereof and illustrating a guitar being supported from the hanger means.

Referring to FIG. 1, the novel hanging fixture of the present invention is illustrated in the direction of arrow 10 and the fixture is shown as being mounted on a road case 11 which usually comprises a main storage compartment having a lid 12 pivotally carried thereon. The road case 11 is employed for storing and transporting musical instruments, equipment employed in stage productions, music stands or the like. The storage container of the road case 11 includes an external side 13 on which the hanging fixture 10 is secured. In one form of the invention, the hanging fixture includes a mounting plate 14 having an edge marginal region 15 that is secured to the external surface 13 by a plurality of fasteners, such as screws, as indicated by numeral 16. Outwardly projecting from the mounting plate 14, there is provided a hanging member or yoke, indicated by numeral 17, from which a musical instrument such as a guitar downwardly depends. Numeral 18 refers to the musical instrument and in some instances, the fret board of the instrument includes angled portions against which the yoke 14 rests so that the hanging member or yoke 17 pivots accordingly to accommodate such an angular displacement.

Figure 2:
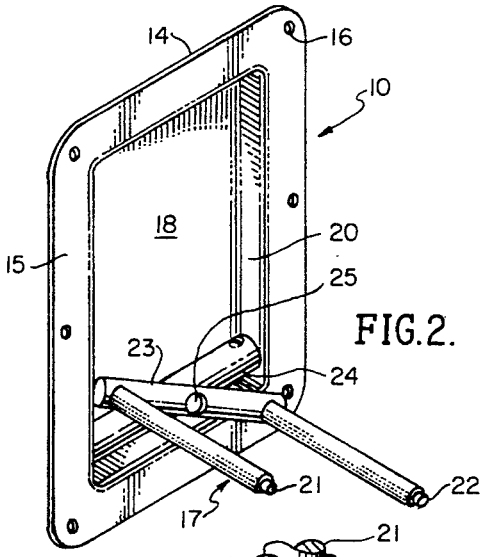
FIG. 2 is a front perspective view of the novel hanger fixture of the present invention illustrating the hanger yoke in its operative outwardly projecting position.

Referring now in detail to FIG. 2, it can be seen that the edge marginal region 15 of the mounting plate 14 surrounds and defines a recessed portion of the mounting plate which comprises a support member 18 having a continuous sidewall 20 which defines the recess. The edge marginal region 15, bottom or support member 18 and the continuous sidewall 20 may be formed from an integral sheet of material. It is also to be noted that the hanger member or yoke 17 includes a pair of outwardly projecting support members 21 and 22 which are connected to the opposite ends of a bar 23. The support members 21 and 22 are arranged in fixed spaced-apart parallel relationship and the bar 23 is pivotally mounted on a rotatable shaft 24 by means of pivot 25.

As illustrated in FIG. 2, the instrument hanger member or yoke 17 is illustrated in its operative position and is further illustrated as being rotated about its pivot 25 in order to accommodate an angular fret board of the instrument. It is to be understood that in some instances, the fret board at its end may be straight rather than angular so that the yoke 17 can be pivoted to a horizontal position rather than angular. Therefore, accommodation is made by the present invention for shape of the end of the fret board 18 on a musical instrument, such as a guitar.

Figure 3:
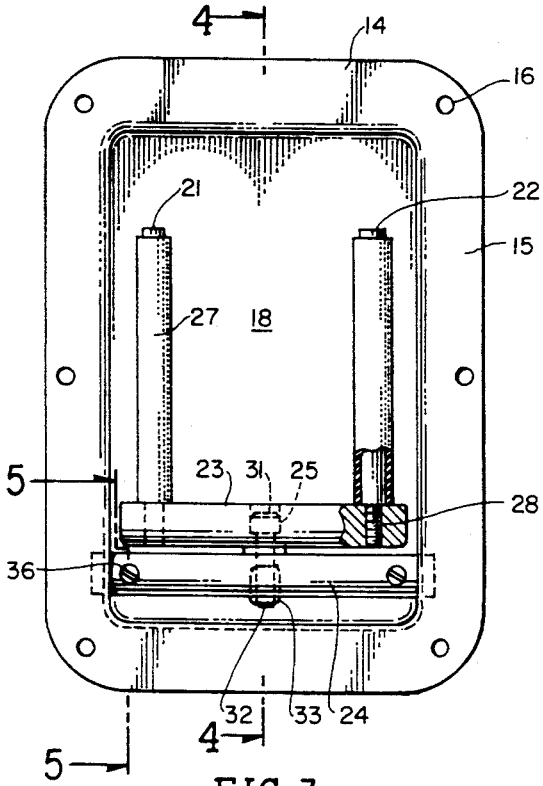
FIG. 3 is a front elevational view, partly in section, illustrating the hanger means of FIG. 2 showing the hanger yoke in its storage position.

Referring now in detail to FIG. 3, it can be seen that each of the respective support members 21 and 22 are provided with a threaded end which is in threaded securement with the opposite ends of the rod 23. If desired, the support members 21 and 22 may be covered with a cushion material, such as plastic, rubber or the like, and such a covering is indicated by numeral 27. The threaded securement of hanger member 22 of the yoke 17 is illustrated by numeral 28 and is identical for the other support member 21.

Also illustrated in FIG. 3 is the mounting of rod 23 onto the rotatable shaft 24 by means of the pivot 25. The opposite ends of the shaft 24 are mounted through holes in the sidewall 20 so that it will rotate causing the hanging members or yoke 17 to either outwardly extend in its operative position as shown in FIG. 2 or rotated to a position within the recess against the bottom or back wall 18, as illustrated in FIG. 3. This latter position is referred to as a storage position.

Figure 4:
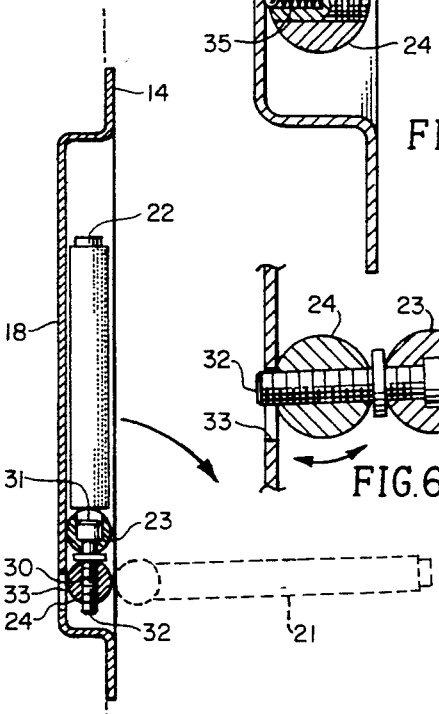
FIG. 4 is a longitudinal cross-sectional view of the hanger fixture shown in FIG. 3 as taken in the direction of arrows 4—4 thereof.
Figure 6:
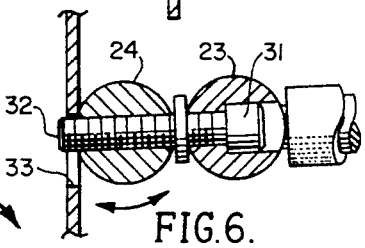
FIG. 6 is an enlarged fragmentary sectional view of the limit stop retaining the hanger yoke in its angular position.

Referring now in detail to FIG. 4, the pivot 25 is more clearly illustrated which may be said to comprise an elongated screw 30 that has one end in threadable engagement with the shaft 24 while its opposite end includes a head which is recessed into a shallow hole carried in the rod 23. This latter construction is indicated by numeral 31. Therefore, it can be seen that when the shaft 24 has been rotated so that the yoke is in the dotted line position indicative of its operative position, the yoke is in condition for receiving a musical instrument from which it will downwardly depend. It is also to be noted that the screw 30 includes an extended portion 32, such as indicated in FIG. 6, that will extend through an opening 33 in the back plate or support 18 and will effectively limit further rotation of shaft 24 so that the yokes or hanger support members 21 and 22 assume a slight slope or angular relationship with respect to a horizontal plane. By this means, the end of the cantilevered support members 21 and 22 is lower at its end connected to shaft 24 whereas their opposite ends which are outwardly cantilevered are slightly above. In this fashion, members carried on the yoke will not have a tendency to slip or fall from their hanging support. Again, it is important to note that the extended portion 32 of the screw 30 forms a limit stop with the edge of the hole through which it passes when the shaft 23 is rotated.

Figure 5:
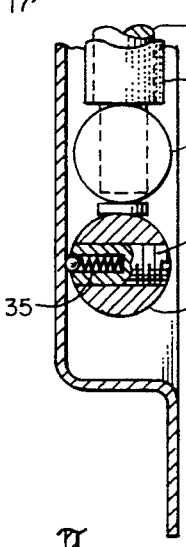
FIG. 5 is an enlarged fragmentary sectional view of the tension or biasing means used in the hanger fixture as taken in the direction of arrows 5—5 of FIG. 3.

Referring now in detail to FIG. 5, it can be seen that a tension is placed on the shaft 24 by means of a spring-loaded ball arrangement, indicated by numeral 35, which is carried in a set screw 36. A pair of such tension devices are incorporated into the opposite ends of the shaft adjacent to its rotatable mounting through holes on the opposing sidewall of the continuous sidewall 20. The tensioning means serves to substantially retain the yoke 17 and its respective hanger support members 21 and 22 in either the storage position or the operative position. The spring-loaded ball of the means bears against the surface of back member 18.

Therefore, it can be seen from the foregoing that the hanger apparatus of the present invention provides a novel means for temporarily storing a musical instrument on the side of a road case while the case may be located onstage during a performance. The instrument is in close proximity to the musician so that he may readily separate the instrument from its storage on the hanger and may replace it with another instrument which is not intended to be played at the time. The device includes a means for placing the yoke in a storage position and an operative position and includes tensioning means for holding the hanger in a storage position when not in use. A limit stop means is provided so that when the hanger support members or yoke is moved to its operative position, a slide angle is provided with the ends of the respective hanger supports 21 and 22 being higher than their ends secured to the bar 23. Also, the yoke may be pivoted about pivot 25 to a selected orientation.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A hanging fixture for a musical instrument comprising:

a mounting plate having a central recess;

a hanger means movably carried on said mounting plate within said plate recess movable between a storage position and an operative position;

said hanger means having a rotatable shaft carried on said mounting plate and a U-shaped yoke pivotably secured to said shaft and partially occupying said plate recess when said hanger means is in its storage position and cantilevered outwardly from said mounting plate when said hanger means is in its operative position; and said hanger means yoke includes a cross bar having opposite ends with a pair of spaced-apart hanger support members secured to said rod ends respectively.

2. The invention as defined in claim 1 including:

a limit stop means carried on said shaft and engageable with said mounting plate to limit movement of said shaft and hanger means yoke when in its operative position.

3. The invention as defined in claim 2 including:

tensioning means yieldably engageable between said shaft and said mounting plate to bias said hanger means into its storage position.

4. The invention as defined in claim 3 wherein:

said mounting plate includes a continuous sidewall having a support portion against which said tensioning means bears and a peripheral edge region about said sidewall defining said central recessed area.

5. The invention as defined in claim 4 including:

a pivot carried on said rod and shaft permitting said hanger means to rotate on said shaft;

an opening provided in said plate supporting portion constituting a part of said limit stop means;

and said pivot having a projection engageable with said support plate through said opening effective to retain said shaft and hanger means in its operative position.

6. The invention as defined in claim 2 wherein:

said limit stop means establishes an upward slant of said hanger means yoke when deployed in its operative position.

* * * * *